US010079427B2

(12) United States Patent
Wang et al.

(10) Patent No.: US 10,079,427 B2
(45) Date of Patent: Sep. 18, 2018

(54) ANTENNA WITH SLITLESS CLOSED FRAME AND WIRELESS COMMUNICATIONS DEVICE

(71) Applicant: Huawei Technologies Co., Ltd., Shenzhen (CN)

(72) Inventors: Jiaming Wang, Shanghai (CN); Rui Zhang, Shanghai (CN); Xiaoli Yang, Shanghai (CN); Meng Hou, Shanghai (CN); Xuefei Zhang, Shenzhen (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 93 days.

(21) Appl. No.: 15/118,276

(22) PCT Filed: Jun. 30, 2014

(86) PCT No.: PCT/CN2014/081224

§ 371 (c)(1),
(2) Date: Aug. 11, 2016

(87) PCT Pub. No.: WO2016/000155

PCT Pub. Date: Jan. 7, 2016

(65) Prior Publication Data

US 2017/0005394 A1 Jan. 5, 2017

(51) Int. Cl.
*H01Q 1/24* (2006.01)
*H01Q 1/48* (2006.01)
(Continued)

(52) U.S. Cl.
CPC ..... *H01Q 1/243* (2013.01); *H01Q 1/48* (2013.01); *H01Q 5/357* (2015.01); *H01Q 5/371* (2015.01);
(Continued)

(58) Field of Classification Search
CPC ..... H01Q 13/106; H01Q 13/10; H01Q 13/103
See application file for complete search history.

(56) References Cited

U.S. PATENT DOCUMENTS

2002/0018020 A1 2/2002 Vernon
2003/0112195 A1* 6/2003 Cheng ..... H01Q 9/42 343/767
(Continued)

FOREIGN PATENT DOCUMENTS

CN 103606736 A 2/2014
CN 103811864 A 5/2014
(Continued)

OTHER PUBLICATIONS

Foreign Communication From a Counterpart Application, Korean Application No. 10-2016-7020655, Korean Office Action dated Jul. 14, 2017, 6 pages.
(Continued)

*Primary Examiner* — Graham Smith
(74) *Attorney, Agent, or Firm* — Conley Rose, P.C.

(57) ABSTRACT

An antenna apparatus and a wireless communications device, where the antenna apparatus includes a feeding part, a grounding part, and a closed frame, where the closed frame encircles a main body of the wireless communications device. The feeding part and the grounding part are electrically connected to the closed frame, and the closed frame, the feeding part, and the grounding part form a first current loop and a second current loop, where resonance is generated between the first current loop and the second current loop. There is no need to dispose a slit on the closed frame of the wireless communications device that uses a metal appearance, and a position of the feeding part of a radio frequency feeder is used, to mitigate impact, of a closed environment caused by not disposing the slit on the closed
(Continued)

frame, on antenna radiation performance, thereby improving antenna performance and user experience.

17 Claims, 7 Drawing Sheets

(51) Int. Cl.

| | |
|---|---|
| ***H01Q 7/00*** | (2006.01) |
| ***H01Q 9/42*** | (2006.01) |
| ***H01Q 5/357*** | (2015.01) |
| ***H01Q 5/371*** | (2015.01) |
| *H01Q 1/44* | (2006.01) |

(52) U.S. Cl.
CPC ..... *H01Q 7/00* (2013.01); *H01Q 9/42* (2013.01); *H01Q 1/44* (2013.01)

(56) References Cited

U.S. PATENT DOCUMENTS

| | | | | |
|---|---|---|---|---|
| 2005/0153756 | A1 | 7/2005 | Sato et al. | |
| 2007/0285321 | A1 | 12/2007 | Chung et al. | |
| 2009/0153407 | A1* | 6/2009 | Zhang | H01Q 1/243 343/702 |
| 2014/0002315 | A1 | 1/2014 | Lim | |

FOREIGN PATENT DOCUMENTS

| | | | |
|---|---|---|---|
| CN | 203589193 | U | 5/2014 |
| EP | 1555715 | A1 | 7/2005 |
| EP | 2680365 | A1 | 1/2014 |
| JP | 2005203878 | A | 7/2005 |
| KR | 20140003213 | A | 1/2014 |

OTHER PUBLICATIONS

Foreign Communication From a Counterpart Application, Korean Application No. 10-2016-7020655, English Translation of Korean Office Action dated Jul. 14, 2017, 4 pages.

Partial English Translation and Abstract of Chinese Patent Application No. CN103811864, Jul. 26, 2016, 3 pages.

Foreign Communication From a Counterpart Application, PCT Application No. PCT/CN2014/081224, English Translation of International Search Report dated Apr. 3, 2015, 2 pages.

Foreign Communication From a Counterpart Application, PCT Application No. PCT/CN2014/081224, English Translation of Written Opinion dated Apr. 3, 2015, 7 pages.

Foreign Communication From a Counterpart Application, European Application No. 14896805.0, Extended European Search Report dated Feb. 23, 2017, 10 pages.

* cited by examiner

ANTENNA WITH SLITLESS CLOSED FRAME AND WIRELESS COMMUNICATIONS DEVICE

CROSS-REFERENCE TO RELATED APPLICATION

This application is a U.S. National Stage of International Application No. PCT/CN2014/081224, filed on Jun. 30, 2014, which is hereby incorporated by reference in its entirety.

TECHNICAL FIELD

The present disclosure relates to the field of antenna technologies, and in particular, to an antenna with a slitless closed frame and a wireless communications device.

BACKGROUND

To improve quality of a wireless communications terminal, metal is increasingly widely applied to appearance design of a mobile phone. Wireless communications is an indispensable function of a wireless device, and an antenna is an indispensable component of a wireless communications terminal. A level of antenna performance is related to various types of wireless communication performance of the wireless communications terminal. For example, antenna performance of a mobile phone affects call quality of a user of the mobile phone. However, based on inherent performance of metal and an antenna, the metal has relatively large impact on performance of the antenna of the wireless communications terminal. Therefore, how to design a high-performance antenna based on a metal appearance becomes a research topic in the industry.

In the prior art, for a wireless communications terminal that has metal-appearance design, slitting processing is performed on one side of a closed frame of the wireless communications terminal, a radio frequency feeder performs feeding excitation on a slit, and the closed frame is utilized, to form a loop antenna. However, because the wireless communications terminal is generally handheld by a user for use, for the foregoing wireless communications terminal in which the closed frame is utilized to form the loop antenna, electric intensity of antenna radiation is strong in the slit of the closed frame. When a hand of the user holds the slit, problems such as frequency offset occur in working resonance of the antenna, which causes a sharp decrease in antenna performance. For example, when the user of the mobile phone uses the mobile phone for a call, if a hand of the user of the mobile phone holds the slit of the slit antenna, phenomena including call drop, suspension, and the like may occur in a call process, which affects use experience of the user.

SUMMARY

Embodiments of the present disclosure provide an antenna apparatus and a wireless communications terminal, which can effectively transfer a position, of a wireless communications terminal that uses a metal appearance, with strongest radiation to an area that is seldom touched when the wireless communications terminal is handheld, thereby alleviating antenna performance deterioration caused by a human body.

According to a first aspect of the present disclosure, an antenna apparatus is provided, including a feeding part, a grounding part, and a closed frame, where the closed frame encircles a main body of a wireless terminal, while the feeding part and the grounding part are electrically connected to the closed frame, and the closed frame, the feeding part, and the grounding part form a first current loop and a second current loop, where resonance is generated between the first current loop and the second current loop.

In a first possible implementation manner of the first aspect, an impedance effect of the first current loop is inductance L, an impedance effect of the second current loop is capacitance C, and resonance is generated between the first current loop and the second current loop, where a resonance frequency is $f=\frac{1}{2\pi\sqrt{C*L}}$.

With reference to the first possible implementation manner of the first aspect, in a second possible implementation manner, a length of the first current loop is less than one-fourth a wavelength, and a length of the second current loop is greater than one-fourth the wavelength but less than half the wavelength.

With reference to the first aspect, or the first possible implementation manner of the first aspect, or the second possible implementation manner of the first aspect, in a third possible implementation manner, the antenna apparatus further includes at least one metal stub.

With reference to the third possible implementation manner of the first aspect, in a fourth possible implementation manner, the at least one metal stub is disposed on a feeder.

With reference to the third possible implementation manner of the first aspect, in a fifth possible implementation manner, the at least one metal stub is disposed on the closed frame.

With reference to the fourth possible implementation manner of the first aspect or the fifth possible implementation manner of the first aspect, in a sixth possible implementation manner, the at least one metal stub is connected to an adjusting switch or an adjustable capacitor, and antenna impedance of the antenna apparatus may be adjusted using the adjusting switch or the adjustable capacitor.

With reference to the sixth possible implementation manner of the first aspect, in a seventh possible implementation manner, the metal stub and the closed frame are connected using a spring or a pogo pin.

With reference to the first aspect, or the first possible implementation manner of the first aspect, or the second possible implementation manner of the first aspect, or the third possible implementation manner of the first aspect, or the fourth possible implementation manner of the first aspect, or the fifth possible implementation manner of the first aspect, or the sixth possible implementation manner of the first aspect, or the seventh possible implementation manner of the first aspect, in an eighth possible implementation manner, the feeding part includes a matching circuit, and the matching circuit is configured to adjust the resonance frequency.

With reference to the first aspect, or the first possible implementation manner of the first aspect, or the second possible implementation manner of the first aspect, or the third possible implementation manner of the first aspect, or the fourth possible implementation manner of the first aspect, or the fifth possible implementation manner of the first aspect, or the sixth possible implementation manner of the first aspect, or the seventh possible implementation manner of the first aspect, or the eighth possible implementation manner of the first aspect, in a ninth possible implementation manner, the feeding part and the grounding part are one of a conductive material, a conductive mechanical part, an inductance/capacitance element with a distributed parameter or a lumped parameter, and transition design with a distributed parameter.

According to a second aspect of the present disclosure, a wireless communications terminal is provided, including the foregoing antenna apparatus.

In a first possible implementation manner of the second aspect, the wireless communications terminal is a mobile phone or a tablet.

It can be learned from the foregoing solutions that according to the antenna apparatus and the wireless communications terminal provided in the embodiments of the present disclosure, there is no need to dispose a slit on a closed frame of a wireless communications terminal that uses a metal appearance, and a position of a feeding part of a radio frequency feeder is used, to mitigate impact, of a closed environment caused by not disposing a slit on the closed frame, on antenna radiation performance. In addition, using at least one metal stub, a position with strongest antenna radiation can be effectively transferred to an area that is seldom touched when the wireless communications terminal is handheld, thereby alleviating antenna performance deterioration caused by a human body. Further, extension of a connection between the at least one metal stub and the closed frame makes it easier to expand a form of an antenna such that the antenna has better broadband performance.

BRIEF DESCRIPTION OF DRAWINGS

To describe the technical solutions in the embodiments of the present disclosure or in the prior art more clearly, the following briefly introduces the accompanying drawings required for describing the embodiments or the prior art. The accompanying drawings in the following description show some embodiments of the present disclosure, and persons of ordinary skill in the art may still derive other drawings from these accompanying drawings without creative efforts.

Figure 1:
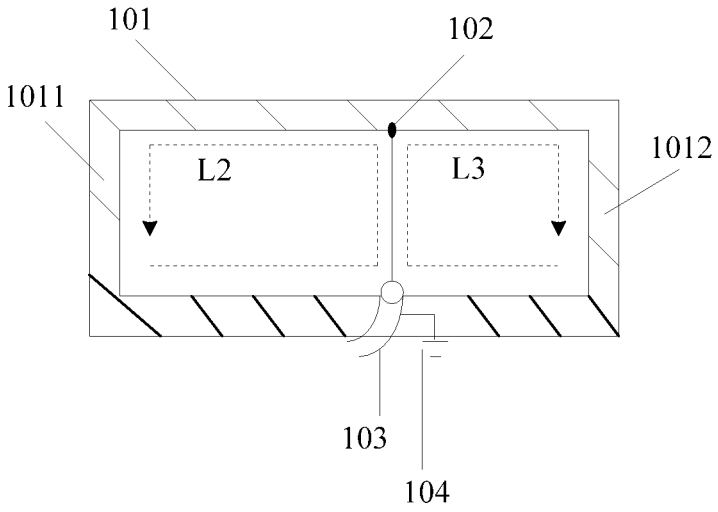
FIG. 1 is a schematic structural diagram of an antenna apparatus according to Embodiment 1 of the present disclosure.

Reference numerals: 101-closed frame, 102-feeding part, 103-radio frequency feeder, 104-grounding part, 107-metal stub disposed on a radio frequency feeder, 108-metal stub disposed on the closed frame.

DESCRIPTION OF EMBODIMENTS

To make the objectives, technical solutions, and advantages of the embodiments of the present disclosure clearer, the following clearly and completely describes the technical solutions in the embodiments of the present disclosure with reference to the accompanying drawings in the embodiments of the present disclosure. The described embodiments are some but not all of the embodiments of the present disclosure. All other embodiments obtained by persons of ordinary skill in the art based on the embodiments of the present disclosure without creative efforts shall fall within the protection scope of the present disclosure.

As shown in FIG. 1, an antenna apparatus, provided in Embodiment 1 of the present disclosure, that is of a wireless communications terminal and has a closed frame 101 includes a feeding part 102 and a grounding part 104, where the feeding part 102 and the grounding part 104 are respectively electrically connected to two opposite sides of the closed frame 101, and the feeding part 102 and the grounding part 104 separate the closed frame 101 into a first part 1011 and a second part 1012, where the first part 1011, the feeding part 102, and the grounding part 104 form a first current loop, and the second part 1012, the feeding part 102, and the grounding part 104 form a second current loop, as indicated by L2 and L3 in the figure. The foregoing first current loop and the foregoing second current loop may be understood as a first loop antenna and a second loop antenna, where L2 and L3 are respectively a perimeter of the first loop antenna and a perimeter of the second loop antenna. According to a transmission line equivalence theory concerning an inverted F antenna (IFA), when a tail end of a transmission line is short-circuited, and a length is less than one-fourth a wavelength, an impedance effect is equivalent to inductance L. When a length of a transmission line is greater than one-fourth the wavelength but less than half the wavelength, an impedance effect is equivalent to capacitance C. Therefore, when appropriate sizes of the first antenna loop and the second antenna loop are selected, a solution of the antenna apparatus shown in FIG. 1 can implement an equivalent model, shown in FIG. 2, of an antenna with a closed frame of an LC parallel circuit. As shown in FIG. 3, two working resonances f2 and f3 in a high frequency band may be generated for loop antennas whose perimeters are L2 and L3.

Figure 2:
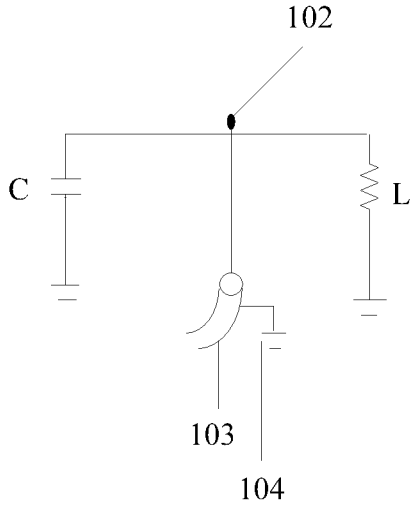
FIG. 2 is a diagram of an equivalent effect of an antenna apparatus according to Embodiment 1 of the present disclosure.
Figure 3:
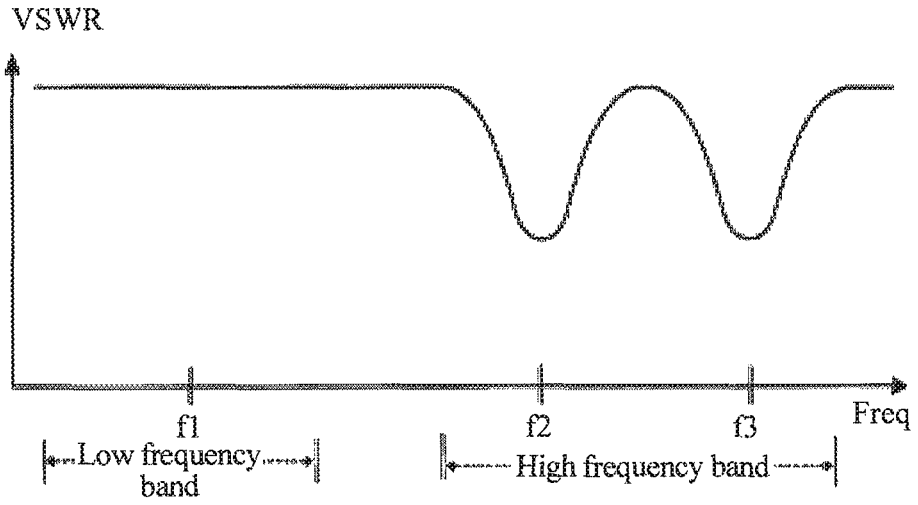
FIG. 3 is a schematic diagram of resonance of an antenna according to Embodiment 1 of the present disclosure.
Figure 4A:
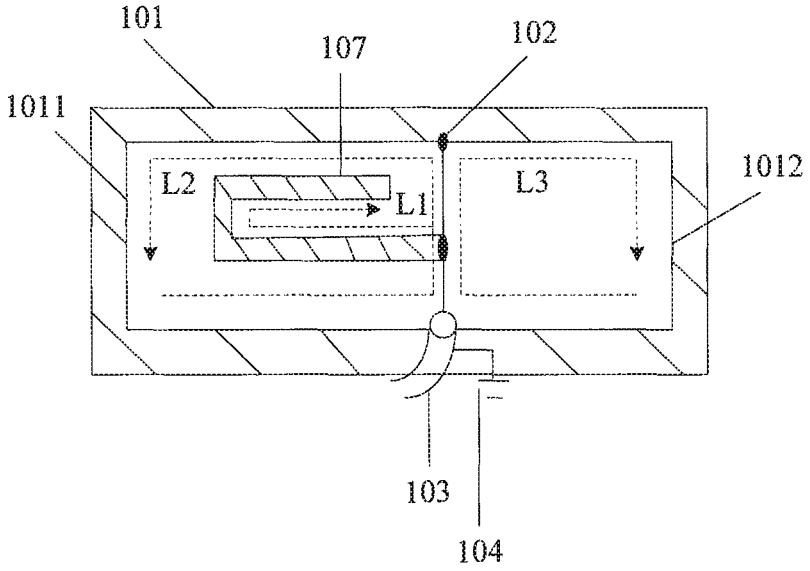
FIG. 4A and FIG. 4B are schematic diagrams of an antenna apparatus according to Embodiment 2 of the present disclosure.

It may be learned from FIG. 2 that resonance can be implemented in a high frequency band using only the first loop antenna and the second loop antenna, but it is difficult to generated available resonance in a low frequency band. In Embodiment 2 of the present disclosure, to implement low-frequency resonance, in an antenna apparatus shown in FIG. 4A, a low-frequency branch (formed by metal stub 107) is added to a radio frequency feeder 103 of an antenna.

Figure 4B:
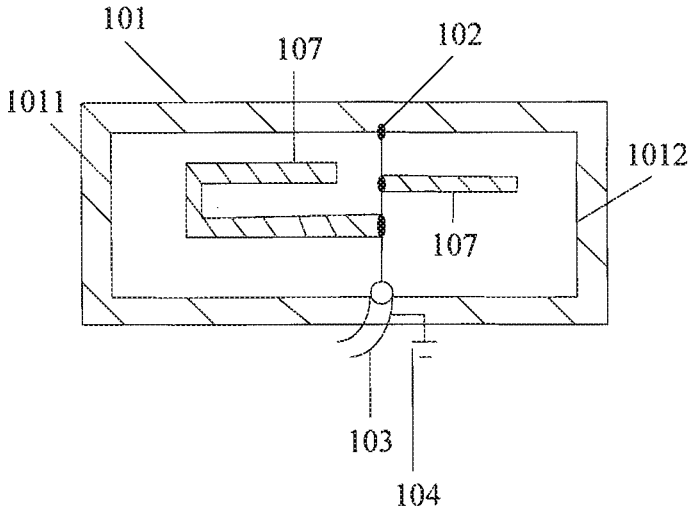
Figure 5:
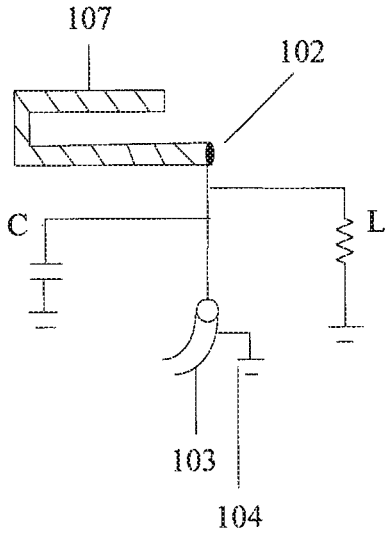
FIG. 5 is a diagram of an equivalent effect of an antenna apparatus in a low frequency band according to Embodiment 2 of the present disclosure.
Figure 6:
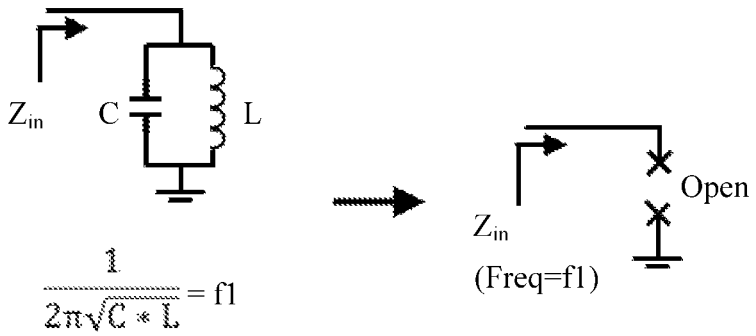
FIG. 6 is a schematic diagram of resonance of an inductance/capacitance (LC) parallel circuit.
Figure 7:
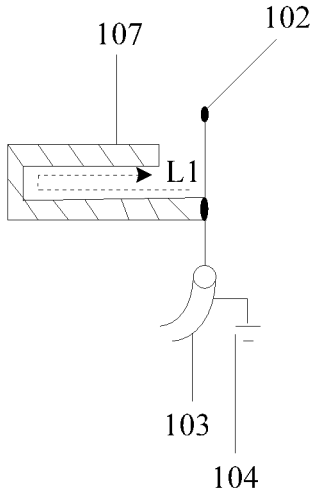
FIG. 7 is a diagram of an equivalent effect of an antenna apparatus according to Embodiment 2 of the present disclosure.

According to a comprehensive effect of an LC parallel circuit, at an LC resonance frequency f1 of the LC parallel circuit, where $f1=\frac{1}{2\pi\sqrt{C*L}}$, an open-circuit state is presented, as shown in FIG. 6. Therefore, when impedance effects C and L of a first loop antenna and a second loop antenna in a low frequency band form an open-circuit state at fl, impedance impact of a closed frame on the low-frequency branch is eliminated such that good low-frequency resonance can be implemented through design of cabling of the low-frequency branch formed by metal stub 107, where an ideal case, as shown in FIG. 7, is equivalent to nonexistence of the closed frame 101. Electric intensity at a tail end of the cabling of the low-frequency branch formed by metal stub 107 is generally the highest, and a position with the highest electric intensity may be adjusted to an area that is seldom touched when the wireless communications terminal is handheld in order to mitigate impact of a human body. The foregoing low-frequency branch disposed on the radio frequency feeder 103 is merely an example, and there is no limitation on a length, a structure, and a quantity of the low-frequency branch, which can be adjusted according to an electrical performance requirement of the antenna. As shown in FIG. 4B, two metal stubs 107 are disposed on the radio frequency feeder 103. In addition, the metal stub 107 may also be an adjustable metal stub. For example, the metal stub 107 is connected to an adjusting switch or an adjustable capacitor. In this way, antenna impedance of the antenna apparatus can be adjusted by adjusting the metal stub 107.

According to the antenna apparatus provided in Embodiment 2 of the present disclosure, there is no need to dispose a slit on a closed frame of a wireless communications terminal that uses a metal appearance, and a position of a feeding part of a radio frequency feeder is used, to mitigate impact, of a closed environment caused by not disposing a slit on the closed frame, on antenna radiation performance. Meanwhile, using a metal stub disposed on the radio frequency feeder, a position with strongest antenna radiation can be effectively transferred to an area that is seldom touched when the wireless communications terminal is handheld, thereby alleviating antenna performance deterioration caused by a human body. In addition, because the antenna apparatus uses a manner in which the closed frame and the metal stub are used in combination, a form of an antenna is easy to expand, which can be adapted to a performance requirement of the wireless communications terminal for an antenna broadband.

Figure 8A:
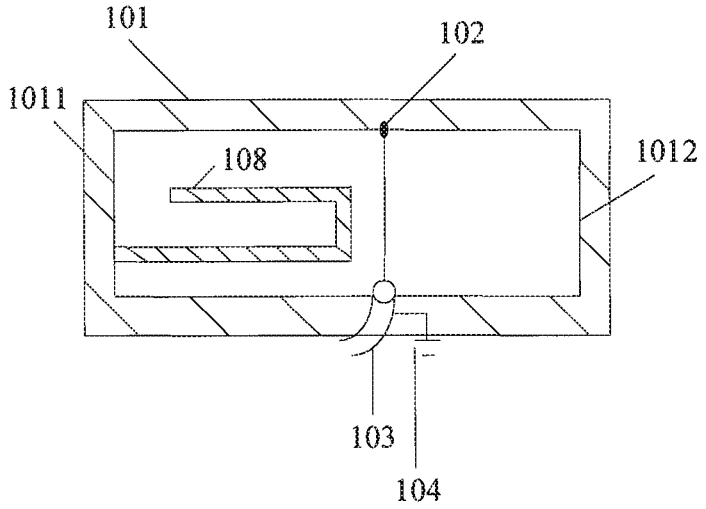
FIG. 8A and FIG. 8B are schematic diagrams of an antenna apparatus according to Embodiment 3 of the present disclosure.
Figure 8B:
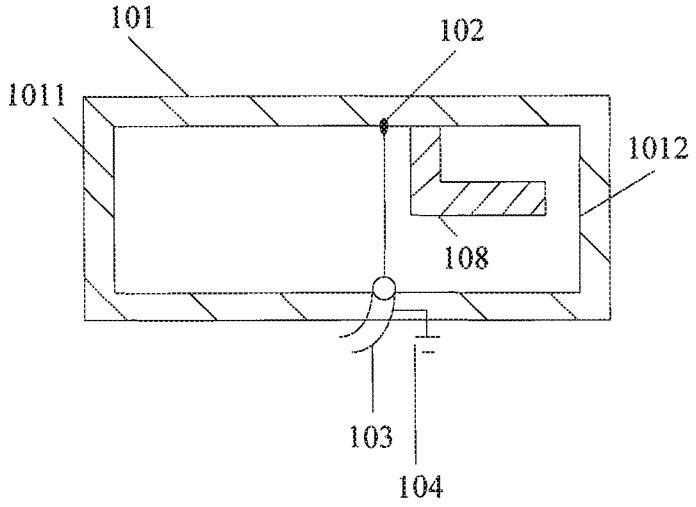
Figure 9:
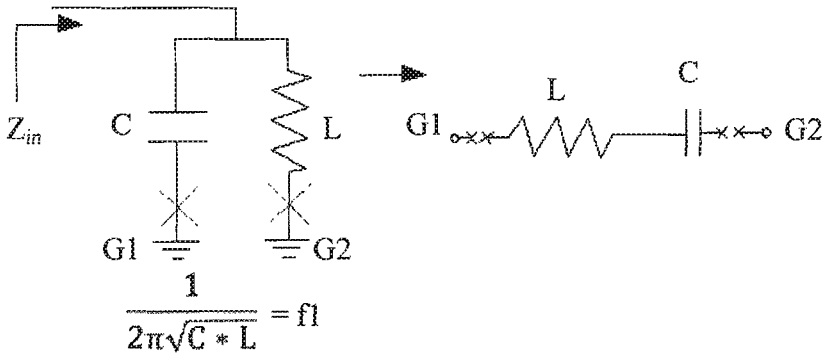
FIG. 9 is a schematic diagram of resonance of an LC series circuit.

The metal stub is disposed on the radio frequency feeder of the antenna provided in the foregoing Embodiment 2. As shown in FIG. 8A or FIG. 8B, in an antenna apparatus provided in Embodiment 3 of the present disclosure, a metal stub 108 is disposed on the closed frame 101. According to a comprehensive effect of an LC series circuit, at an LC resonance frequency f1 of the LC series circuit, where $f1=\frac{1}{2}\pi\sqrt{C*L}$, an open-circuit state is presented, as shown in FIG. 9. Therefore, when impedance effects C and L of a first loop antenna and a second loop antenna in a low frequency band form an open-circuit state at f1, impedance impact of the closed frame on the low-frequency branch formed by metal stub 108 is eliminated such that good low-frequency resonance can be implemented through design of cabling of the low-frequency branch formed by metal stub 108. Electric intensity at a tail end of the cabling of the low-frequency branch formed by metal stub 108 is generally the highest, and a position with the highest electric intensity may be adjusted to an area that is seldom touched when the wireless communications terminal is handheld in order to mitigate impact of a human body. The foregoing low-frequency branch disposed on the closed frame is merely an example, and there is no limitation on a length, a structure, and a quantity of the low-frequency branch, which can be adjusted according to an electrical performance requirement of the antenna. In addition, the metal stub may also be an adjustable metal stub. In this way, antenna impedance of the antenna apparatus can be adjusted by adjusting the metal stub.

According to the antenna apparatus provided in Embodiment 3 of the present disclosure, there is no need to dispose a slit on a closed frame of a wireless communications terminal that uses a metal appearance, and a position of a feeding part of a radio frequency feeder is used, to mitigate impact, of a closed environment caused by not disposing a slit on the closed frame, on antenna radiation performance. Meanwhile, using a metal stub disposed on the closed frame, a position with strongest antenna radiation can be effectively transferred to an area that is seldom touched when the wireless communications terminal is handheld, thereby alleviating antenna performance deterioration caused by a human body. In addition, because the antenna apparatus uses a manner in which the closed frame and the metal stub are used in combination, a form of an antenna is easy to expand, which can be adapted to a performance requirement of the wireless communications terminal for an antenna broadband.

Figure 10A:
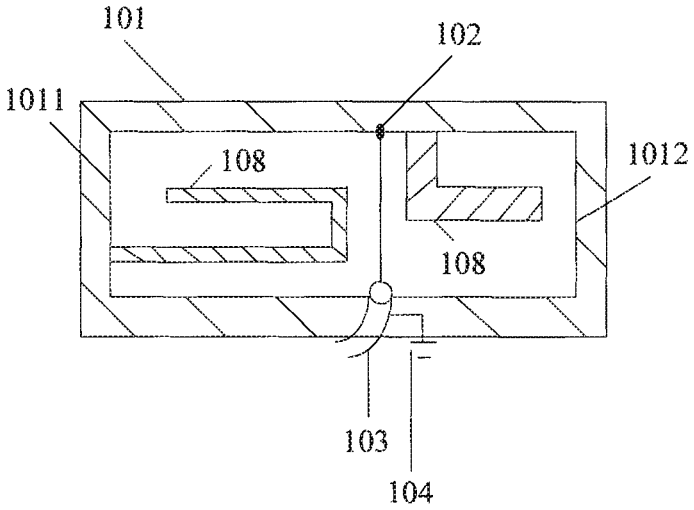
FIG. 10A, FIG. 10B, and FIG. 10C are schematic diagrams of an antenna apparatus according to Embodiment 4 of the present disclosure.
Figure 10B:
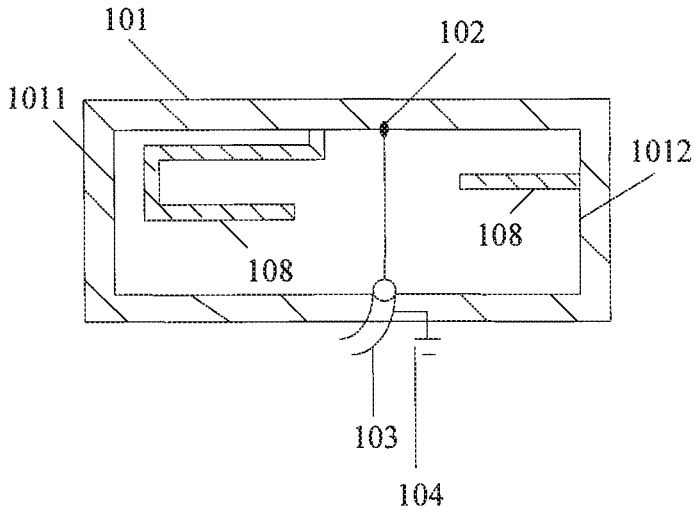
Figure 10C:
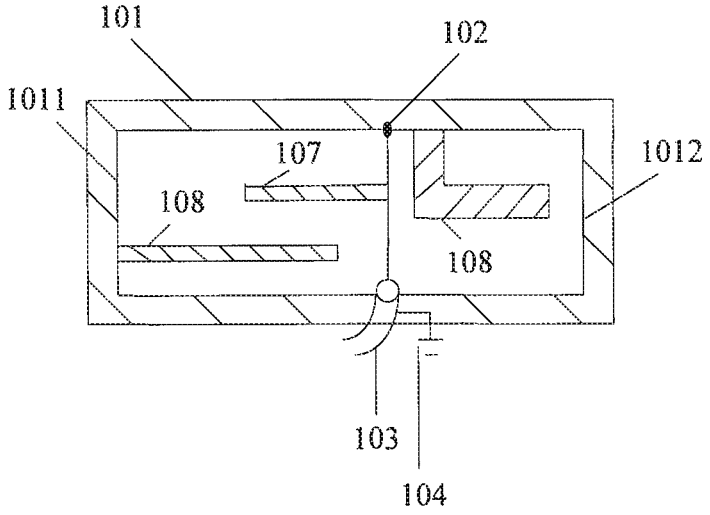

With reference to Embodiment 2 and Embodiment 3, as shown in FIG. 10A, FIG. 10B, and FIG. 10C, in an antenna apparatus provided in Embodiment 4 of the present disclosure, a metal stub 107 is disposed on a radio frequency feeder 103 and a metal stub 108 is disposed on a closed frame 101. According to comprehensive effects of an LC parallel circuit and an LC series circuit, at an LC resonance frequency fl of the LC parallel circuit and the LC series circuit, where $f1=\frac{1}{2}\pi\sqrt{C*L}$, an open-circuit state is presented. Therefore, when impedance effects C and L of a first loop antenna and a second loop antenna in a low frequency band form an open-circuit state at fl, impedance impact of the closed frame 101 on the low-frequency branches formed by metal stub 107 and metal stub 108 is eliminated such that good low-frequency resonance can be implemented through design of cabling of the low-frequency branches formed by metal stub 107 and metal stub 108. Electric intensity at tail ends of the cabling of the low-frequency branches formed by metal stub 107 and metal stub 108 is generally the highest, and a position with the highest electric intensity may be adjusted to an area that is seldom touched when the wireless communications terminal is handheld in order to mitigate impact of a human body. The foregoing low-frequency branch disposed on the radio frequency feeder or the closed frame is merely an example, and there is no limitation on a length, a structure, and a quantity of the low-frequency branch, which can be adjusted according to an electrical performance requirement of the antenna. In addition, the metal stub may also be an adjustable metal stub. For example, the metal stub is connected to an adjusting switch or an adjustable capacitor. In this way, antenna impedance of the antenna apparatus can be adjusted by adjusting the metal stub.

According to the antenna apparatus provided in Embodiment 3 of the present disclosure, there is no need to dispose a slit on a closed frame of a wireless communications terminal that uses a metal appearance, and a position of a feeding part of a radio frequency feeder is used, to mitigate impact, of a closed environment caused by not disposing a slit on the closed frame, on antenna radiation performance. Meanwhile, using a metal stub disposed on the closed frame, a position with strongest antenna radiation can be effectively transferred to an area that is seldom touched when the wireless communications terminal is handheld, thereby alleviating antenna performance deterioration caused by a human body. In addition, because the antenna apparatus uses a manner in which the closed frame and the metal stub are used in combination, a form of an antenna is easy to expand, which can be adapted to a performance requirement of the wireless communications terminal for an antenna broadband.

In the antenna apparatus in each of the foregoing embodiments, there is no limitation on a position of a connection point between the metal stub and the closed frame and a position of a connection point between the metal stub and the radio frequency feeder, where the positions are further adjusted according to an electrical performance requirement of an antenna. There is either no limitation on a manner of connecting the metal stub to the closed frame and the radio frequency feeder, and the metal stub may be connected to the closed frame and the radio frequency feeder in a manner such as a metal spring connection or a pogo pin connection.

According to the antenna apparatus in each of the foregoing embodiments, a manner of electrically connecting the feeding part and the grounding part to the closed frame is not limited, where the feeding part and the grounding part may be various conductive materials, such as conductive fabric and conductive foam, or conductive structural parts such as a spring and a welding joint, various inductance/capacitance elements with a distributed parameter or a lumped parameter, or transition design with a distributed parameter.

According to the antenna apparatus in each of the foregoing embodiments, the feeding part includes a matching circuit, and the matching circuit is configured to adjust the resonance frequency.

Embodiment 4 of the present disclosure provides a wireless communications terminal, where the wireless communications terminal includes the antenna apparatus according to each of the foregoing embodiments. The wireless communications terminal is a mobile phone or a tablet.

The wireless communications terminal provided in Embodiment 4 of the present disclosure uses the antenna apparatus according to each of the foregoing embodiments. Therefore there is no need to dispose a slit on a closed frame of the wireless communications terminal, which effectively enhances flexibility in appearance design of the wireless communications terminal and simplifies structure design. In addition, because the antenna apparatus of the wireless communications terminal uses a manner in which the closed frame and a metal stub are used in combination, a form of an antenna is easy to expand, which can be adapted to a performance requirement of the wireless communications terminal for an antenna broadband. Persons skilled in the art can make various modifications and variations to the present disclosure without departing from the spirit and scope of the present disclosure. The present disclosure is intended to cover these modifications and variations provided that they fall within the scope of protection defined by the claims and their equivalent technologies of the present disclosure.

Finally, it should be noted that the foregoing embodiments are merely intended for describing the technical solutions of the present disclosure, but not for limiting the present disclosure. Although the present disclosure is described in detail with reference to the foregoing embodiments, persons of ordinary skill in the art should understand that they may still make modifications to the technical solutions described in the foregoing embodiments or make equivalent replacements to some or all technical features thereof, without departing from the scope of the technical solutions of the embodiments of the present disclosure.

The invention claimed is:

1. An antenna apparatus, comprising:

a feeding part;

at least one metal stub coupled to the feeding part; a grounding part; and a closed frame electrically coupled to the feeding part and the grounding part such that the feeding part and the grounding part are on opposite sides of the closed frame, the closed frame encircling a main body of a wireless terminal, the closed frame, the feeding part, and the grounding part forming a first current loop and a second current loop, resonances f1, f2 and f3 being generated between the first current loop and the second current loop, an impedance effect of the first current loop being equivalent to inductance L, an impedance effect of the second current loop being equivalent to capacitance C, a reciprocal of resonance frequency f1 being $f=1/(2\pi\sqrt{C*L})$, f1 being in low-frequency band, f2 and f3 being in a high frequency band, a perimeter of the first current loop being less than one-fourth a wavelength, and a perimeter of the second current loop being greater than one-fourth the wavelength but less than half the wavelength.

2. The antenna apparatus according to claim 1, wherein a perimeter of the first current loop is less than one-fourth of a wavelength, and a perimeter of the second current loop is greater than one-fourth of the wavelength but less than half of the wavelength.

3. The antenna apparatus according to claim 1, wherein the at least one metal stub is disposed on the closed frame.

4. The antenna apparatus according to claim 1, wherein the at least one metal stub is connected to an adjusting switch, and an antenna impedance of the antenna apparatus is adjusted using the adjusting switch.

5. The antenna apparatus according to claim 4, wherein the metal stub and the closed frame are connected using a spring.

6. The antenna apparatus according to claim 1, wherein the feeding part comprises a matching circuit, and the matching circuit is configured to adjust the resonance frequency.

7. The antenna apparatus according to claim 1, wherein the feeding part and the grounding part are a conductive material.

8. A wireless communications terminal, comprising:

an antenna apparatus comprising:

a feeding part;

at least one metal stub coupled to the feeding part;

a grounding part; and a closed frame electrically coupled to the feeding part and the grounding part such that the feeding part and the grounding part are on opposite sides of the closed frame, the closed frame encircling a main body of a wireless terminal, the closed frame, the feeding part, and the grounding part forming a first current loop and a second current loop, resonances f1, f2 and f3 being generated between the first current loop and the second current loop, an impedance effect of the first current loop being equivalent to inductance L, an impedance effect of the second current loop being equivalent to capacitance C, a reciprocal resonance frequency fl being $f=1/(2\pi\sqrt{C*L})$, and f1 being in low-frequency band, f2 and f3 being in a high frequency band, a perimeter of the first current loop being less than one-fourth a wavelength, and a perimeter of the second current loop being greater than one-fourth the wavelength but less than half the wavelength.

9. The wireless communications terminal according to claim 8, wherein the wireless communications terminal is a mobile phone or a tablet.

10. The antenna apparatus according to claim 1, wherein the at least one metal stub is connected to an adjustable capacitor, and an antenna impedance of the antenna apparatus is adjusted using the adjustable capacitor.

11. The antenna apparatus according to claim 4, wherein the metal stub and the closed frame are connected using a pogo pin.

12. The antenna apparatus according to claim 1, wherein the feeding part and the grounding part are a conductive mechanical part.

13. The antenna apparatus according to claim 1, wherein the feeding part and the grounding part are an inductance element with a distributed parameter.

14. The antenna apparatus according to claim 1, wherein the feeding part and the grounding part are an inductance element with a lumped parameter.

15. The antenna apparatus according to claim 1, wherein the feeding part and the grounding part are a capacitance element with a distributed parameter.

16. The antenna apparatus according to claim 1, wherein the feeding part and the grounding part are a capacitance element with a lumped parameter.

17. The antenna apparatus according to claim 1, wherein the feeding part and the grounding part are a transition design with a distributed parameter.

* * * * *